United States Patent [19]

Burton-Smith

[11] 4,253,772

[45] Mar. 3, 1981

[54] MIXING PAIL

[76] Inventor: Clement W. Burton-Smith, 112 Alta Vista Ave., Mill Valley, Calif. 94941

[21] Appl. No.: 68,644

[22] Filed: Aug. 22, 1979

[51] Int. Cl.[3] ..... B01F 13/00

[52] U.S. Cl. ..... 366/130

[58] Field of Search ..... 366/130, 202, 210, 211, 366/216, 226, 228, 237, 238, 306; 68/152, 153, 154, 171, 172, 173, 174, 213

[56] References Cited

U.S. PATENT DOCUMENTS

| | | | |
|---|---|---|---|
| 627,805 | 6/1899 | Cox | 366/237 |
| 1,629,761 | 5/1927 | Woodrow | 68/174 |
| 1,754,951 | 4/1930 | Hollier | 68/174 |
| 1,989,019 | 1/1935 | O'Keeffe | 366/130 |
| 2,156,541 | 5/1939 | Misenhimer et al. | 68/174 X |

*Primary Examiner*—Philip R. Coe

*Attorney, Agent, or Firm*—Naylor, Neal & Uilkema

[57] ABSTRACT

A mixing device is made up of a pail and a pair of parallel, offset, oppositely directed baffles fixedly secured to the interior of the pail.

5 Claims, 5 Drawing Figures

MIXING PAIL

BACKGROUND OF THE INVENTION

The invention relates to the mixing of liquids and, more particularly, to the provision of a pail into which liquid samples may be placed and mixed together to obtain a homogeneous overall sample.

The pertinent prior art known to applicant consists of U.S. Pat. Nos. 1,629,761 and 2,323,795. The former shows a washing machine having agitator blades of a somewhat similar shape to the mixing blades of the present mixing pail. The latter shows a liquid container having an apertured mixing blade which is loosely disposed in the container.

SUMMARY OF THE INVENTION

The mixing pail of the invention comprises a pair of offset but generally oppositely disposed apertured baffles which in conjunction with the passageways defined between the baffles and the pail provide for a particularly efficient swirling and mixing together of the liquid contents of the pail. Mixing is accomplished by rotating the pail back and forth about its vertical axis by manipulation of the pail or handle.

The essential object of the invention is to provide a simple and efficient mixing container to receive and homogenize a plurality of liquid samples taken at different levels from a large body of liquid.

THE DRAWING

THE PREFERRED EMBODIMENT

Figure 1:
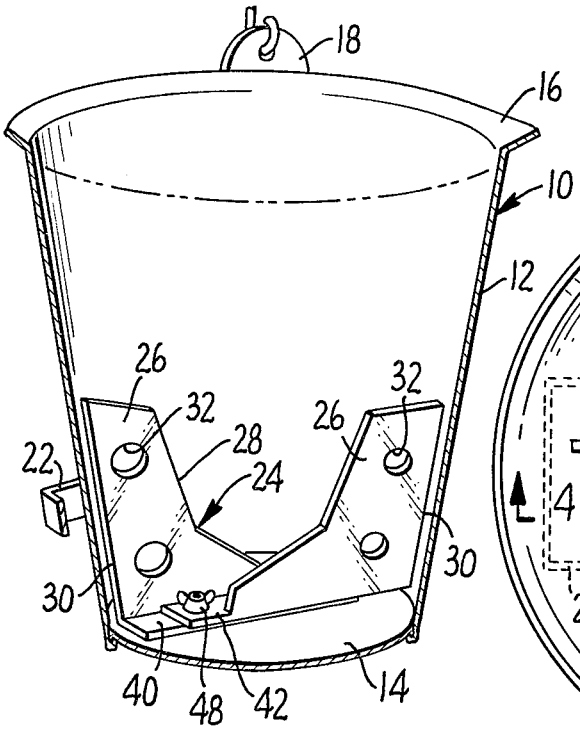
FIG. 1 is a view in perspective of the subject mixing pail.
Figure 3:
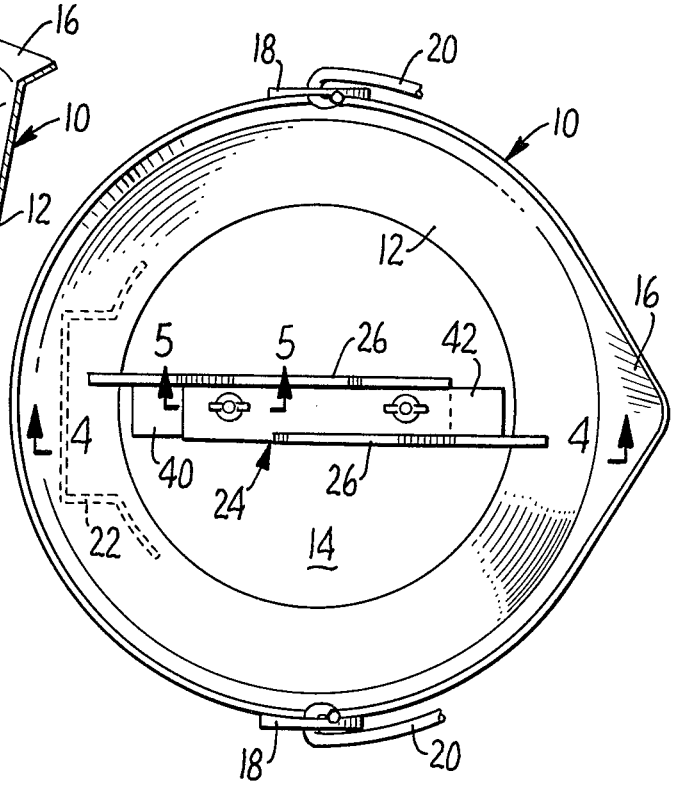
FIG. 3 is a top plan view of the mixing pail.
Figure 2:
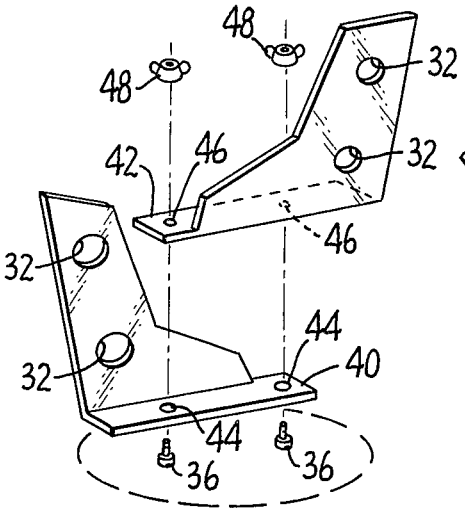
FIG. 2 is a view in perspective showing in exploded relation the mixing baffles and their attachment means.

Pail 10 comprises a frusto-conical sidewall 12, bottom wall 14, pouring lip 16, ears 18, a carrying bail 20 pivotally attached to the ears, a tipping or pouring handle 22, and mixing means indicated generally at 24 positioned within the pail and attached to the bottom wall 14.

The mixing means comprises a pair of baffles 26 which are fixedly positioned in the pail in parallel, laterally offset, oppositely directed relation to each other. The baffles are provided with downwardly and inwardly inclined inner edges 28 which may be formed of a plurality of intersecting straightedge portions, as shown, or may be formed as a single curvilinear segment. The rear edges 30 of the baffles extend parallel to the sidewall 12 of the pail and are disposed in slightly spaced relation thereto for a purpose hereinafter described. The baffles are provided with a plurality of apertures 32 to promote liquid mixing, as hereinafter described.

The attachment means for the baffles comprises a pair of threaded stud elements 34 having heads 36 which are secured, as by welds 38 to the pail bottom 14. The baffles 26 are provided with foot flanges 40 and 42, the former being provided with apertures 44 adapted to receive the heads 36 of the attachment means and the latter being provided with smaller apertures 46 adapted to receive the threaded portions of the stud elements 34. Wing nuts threadably attached to the stud elements serve to clamp the two flanges 40 and 42 together and against the bottom wall of the pail.

The subject mixing pail is particularly adapted for use in connection with the sampling for test purposes of a relatively large, contained body of liquid, such as a railroad tank car filled with a liquid such as glycerine. It is customary to take liquid test samples at different levels from such tank cars and then combine the test samples and mix them together to obtain an overall average sample for use in checking the specifications of the liquid in question. The present mixing pail serves to efficiently and quickly mix together and homogenize a plurality of such liquid samples.

The test samples are all deposited in the pail. The pail is then suspended by hand from the bail 20 and the latter is rotated back and forth to rapidly rotate the pail about its vertical axis in alternately clockwise and counterclockwise directions. This results in the liquid being thoroughly mixed after a few such rotations as a result of the overall mixing flow of the liquid through and between the baffles 26 and through the apertures 32. A degree of mixing flow also takes place through the spaces provided between the baffle edges 30 and the sidewall 12 of the pail. These spaces also serve the purpose of enabling the baffles to be installed in pails which have somewhat bent or deformed sidewalls 12.

The mixing efficiency of the present mixing pail is such that a cumulative sample of liquid may be mixed to a homogeneous condition by applying about three cycles of back and forth rotation to the pail.

Figure 4:
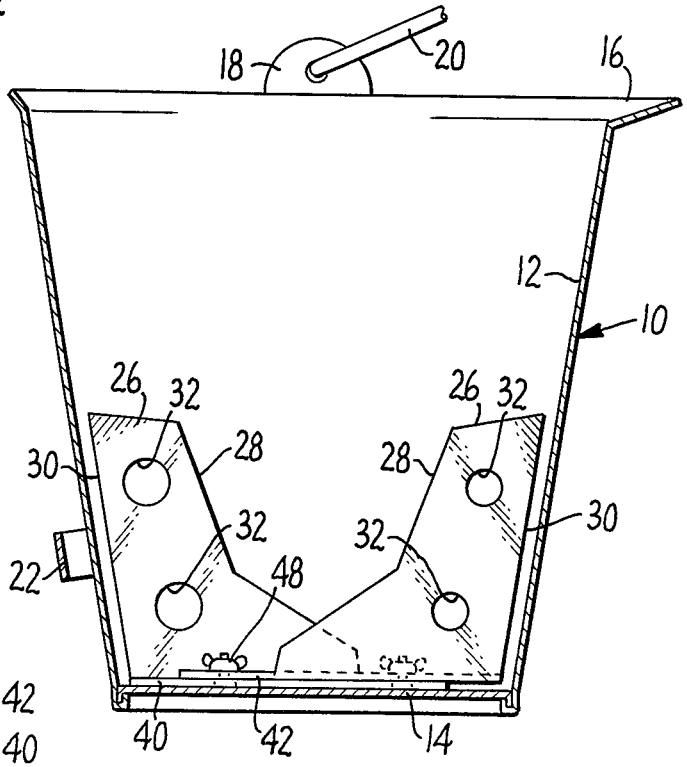
FIG. 4 is a view taken along lines 4—4 of FIG. 3.
Figure 5:
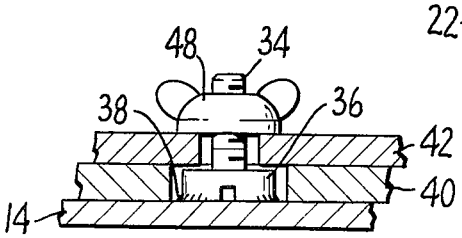
FIG. 5 is an enlarged view taken along lines 5—5 of FIG. 3.

As viewed in FIG. 4, the shape of the opening defined by the baffle edges 28 is generally bowl-shaped. For the best mixing results, this opening should be about half the size in area of the combined flow-opposing areas of the two baffles.

Also, for best mixing results, the inner end portions of the baffles should overlap for a distance which exceeds the distance between the baffles measured along a line normal to the baffles.

The removability of the baffles from the pail enables the pail and the baffles to be cleaned and replaced in the event of damage.

What is claimed is:

1. A mixing device comprising a pail, a pair of vertically disposed, planar baffles attached to the bottom of the pail, said baffles being oppositely directed with respect to each other and being symmetrically disposed with respect to an imaginary, vertical, diametral plane extending through said pail, said baffles having inner end portions disposed in overlapping relation to each other, and said baffles having inwardly and downwardly inclined inner edges which when viewed in a direction normal to said diametral plane jointly define a generally bowl-shaped baffle-free space.

2. The mixing device of claim 1, said baffles being provided with flow-through apertures and having their outer edges disposed in spaced relation to the side of said pail.

3. The mixing device of claim 1, said pail being provided with a handle whereby said pail may be suspended and rotationally twirled back and forth to effect a mixing of liquid within the pail.

4. A mixing device comprising a pail, a pair of vertically disposed, planar baffles attached to the bottom of the pail, said baffles being oppositely directed with respect to each other and being spaced apart with respect to each other, said baffles being removably attached to the bottom of said pail by means comprising threaded stud elements fixedly attached to the bottom of the pail, a foot flange on each baffle, one of said foot flanges being disposed in superposed relation to the other of said foot flanges, said flanges being provided with apertures for said stud elements, and wing nuts threadably attached to said stud elements in clamping relation with respect to said foot flanges.

5. The mixing device of claim 1, the distance of overlap of the inner end portions of said baffles exceeding the distance between said baffles measured along a line normal to said diametral plane.

* * * * *